US005088070A

United States Patent [19]

Shiff

[11] Patent Number: 5,088,070

[45] Date of Patent: Feb. 11, 1992

[54] SELECTING APPARATUS FOR A MULTIMODE ELECTRONIC WRIST INSTRUMENT

[75] Inventor: Victor Shiff, Waterbury, Conn.

[73] Assignee: Timex Corporation, Waterbury, Conn.

[21] Appl. No.: 696,402

[22] Filed: May 6, 1991

[51] Int. Cl.[5] ..... G04B 47/00; G04C 17/00; G09G 3/02

[52] U.S. Cl. ..... 368/10; 368/69; 368/82; 368/187; 340/706; 340/711

[58] Field of Search ..... 368/10, 69-70, 368/82-84, 185-187, 239, 240, 319-321; 340/706, 709, 711, 712; 364/705, 709, 710

[56] References Cited

U.S. PATENT DOCUMENTS

| | | | |
|---|---|---|---|
| 4,115,993 | 9/1978 | Moriya | 368/250 |
| 4,257,115 | 3/1981 | Hatuse et al. | 368/69 |
| 4,283,784 | 8/1981 | Horan | 368/87 |
| 4,354,260 | 10/1982 | Planzo | 368/10 |
| 4,395,134 | 7/1983 | Luce | 368/10 |
| 4,432,652 | 2/1984 | Munekata et al. | 368/69 |
| 4,783,773 | 11/1988 | Houlihan et al. | 368/108 |

OTHER PUBLICATIONS

Tiger Electronics Inc. advertisement (copyright 1989) for "Double Dragon" LCD Video Game.

*Primary Examiner*—Vit W. Miska
*Attorney, Agent, or Firm*—William C. Crutcher

[57] ABSTRACT

A selecting apparatus for a multimode electronic wrist instrument. A microcomputer in the wrist instrument is programmed to sequentially actuate selecting indicia similar to a cursor horizontally and/or vertically on the display to indicate a selectable function for the timepiece. At least four directional switches are operated by movement of an operator's finger with respect to a central reference position. The microcomputer is further programmed to select the selectable operating function displayed when a selecting switch is operated. In one embodiment of the invention, the manual actuating means comprises four separate directional actuators arranged about a central actuator which operates the selecting switch. In another embodiment, the manual actuating means is a single member adapted to movement in at least four directions corresponding to movement of the selecting indicia on the display and also adapted to be depressed in the center to operate the selecting switch. The functions selected may comprise operating modes of the wrist instrument or may comprise alphanumeric characters and/or mathematical operators.

15 Claims, 6 Drawing Sheets

| CURSOR LOCATION | | PREVIOUS SELECTION | |
|---|---|---|---|
| X | Y | X | Y |
| A | 3 | B | 1 |

SELECTING APPARATUS FOR A MULTIMODE ELECTRONIC WRIST INSTRUMENT

BACKGROUND OF THE INVENTION

This invention relates generally to a multimode electronic wrist instrument and more particularly to improved apparatus for selecting a function to be carried out or used by the wrist instrument. More particularly, the invention relates to an improved arrangement of manually actuated switches and an improved program for a wrist instrument incorporating a micro computer and an electro optical display Multimode, multi-function wristwatches (or wrist instruments) are known which include a display, an audible alarm device or beeper, a number of manually actuated switches and an integrated circuit programmed to carry out selected functions and steps of an operating program in a preselected sequence. Examples of such watches are seen in U.S. Pat. No. 4,783,773—Houlihan et.al., U.S. Pat. No. 4,780,864—Houlihan and U.S. Pat. No. 4,283,784—Horan, all of the foregoing being assigned to the present assignee. In the foregoing patents, which are merely exemplary of multimode electronic wrist instruments or multi-function wristwatches, one of the manual actuators may typically serve to repetitively cycle the instrument through a number of operational modes or operating states in each of which a different type of information is displayed. Such modes may include, in a multifunction watch, the time of day, chronograph, dual time zone, elapsed time and an alarm setting mode. By special actuation of one of the preselected switches, the wristwatch may be further converted into a calculator, a speedometer, a pedometer, a pulsimeter or any other type of device which will perform calculations and display data, subject only to the imagination of the designer and programmer of the integrated circuit. While in any of these modes, one or more manual switch actuators may be employed to enter information or to initiate calculations. The information entered usually comprises alphanumeric characters or mathematical operators which in turn may be selected by manual actuators.

In such a multimode watch, selection of modes, operating functions, and data is usually accomplished by an operator's finger pressing manual actuators or push buttons. The actuators are usually located around the edge of the case of the wrist instrument or in some cases on the upper surface of the wrist instrument. Although manufacturers strive to provide some association between the functions performed by the manual actuators, frequently it is left to the operator of the wrist instrument to remember which function is performed by which manual actuator.

As electronic wrist instruments become more and more complex, the input operations required by the human operator of the wrist instrument become more difficult. An alternative to an operating sequence controlled by manual actuators spaced around the case of the wrist instrument is a keyboard containing alphanumeric characters (numbers or alphabetical characters) and/or mathematical operators. Such a keyboard is illustrated in U.S. Pat. No. 4,817,065 issued Mar. 28, 1989 to Usui for a calculator watch. When a keyboard is located on the watch case, the size of the individual manual actuators or keys is so small that erroneous entries are often made or a stylus is required.

A few electronic wrist instruments or electronic timepieces have provided an electro optic display, in which a "menu" indicates a selection of operating modes or functions to be performed. Examples of such watches are the Windsurfer watch manufactured by Citizen Watch Company and the DBX-100 Databank Watch manufactured by Casio Computer Corp. Both display a menu of selectable modes with an actuatable selecting indicia to indicate the selected choice. The selection is changed by repetitively pressing a pushbutton on the watch case.

Digit input switches are known for timepieces in which the location of the actuator is associated with the location of the selected input data. Examples of such timepieces are shown in U.S. Pat. No. 4,257,115—Hatuse, et.al. issued Mar. 17, 1981 and U.S. Pat. No. 4,432,652—Munekata, et.al. issued Feb. 21, 1984, wherein switches are disposed in a location on the dial corresponding to the display indicia. Timepieces, in which a menu or series of selections are actuated or indicated by a pointer on an electro optical display by operating a manual actuator whose physical location has no relationship with the displayed selection, are shown in U.S. Pat. No. 4,115,993 Moriya issued Sept. 26, 1978 and in U.S. Pat. No. 4,354,260 Planzo issued Oct. 12, 1982. Manual actuators for operating multiple switch contacts on a timepiece are known from U.S. Pat. No. 4,244,044—Olsson issued Jan. 6, 1981; U.S. Pat. No. 4,005,400—Engdahl issued Jan. 25, 1977 in U.S. Pat. No. 4,395,134—Luce issued July 26, 1983. The latter Luce patent illustrates a multi-position joy stick type control switch for controlling the directional movement of a game element across the face of a game watch by means of four directional switch contacts operated by the joy stick.

It would be desirable to have an improved selecting apparatus for a multimode electronic wrist instrument which reduces the need for multiple push buttons or a key pad, thereby allowing a larger display on the face of the wrist instrument or timepiece.

Accordingly, one object of the present invention is to provide an improved selecting apparatus in which the operation of the input switches on the case is associated with movement of the displayed selectable function.

Another object of the invention is to provide an improved selecting apparatus for a multimode electronic wrist instrument which reduces the number of manual actuators needed to select the function performed by the wrist instrument, and arranges them in an understandable way.

Still another object of the invention is to provide improved manual actuating means and improved operating programs for selecting the functions such as operating mode or data selection performed by a wrist instrument.

SUMMARY OF THE INVENTION

Briefly stated, the invention comprises an improved selecting apparatus for a multimode electronic wrist instrument of the type having a wrist-mounted case, a microcomputer or microcontroller in the case programmed to provide multiple functions including timekeeping, and an electro optical display having actuatable display indicia, the improved apparatus comprising selecting indicia arranged on the display in at least first and second transversely spaced lines adapted to indicate a selectable function, switches in the case connected to the microcomputer, the microcomputer being programmed to sequentially actuate the selecting indicia along a line or to transfer the selecting indicia transversely between lines to indicate a selectable function for the timepiece or to select the function in response to operation of one of the switches, and manual actuating means disposed on the outside of the case adapted to operate at least four directional switches by movement of an operator's finger with respect to a central reference position and to operate a selecting switch by subsequent depression of the actuating means at the central reference position. The actuating means is oriented on the case to correspond to the directional orientation of selecting indicia on the display. The microcomputer includes a first memory location for storing a first function for operating the wrist instrument in accordance with the first function, a second memory location for storing a second function corresponding to the selectable function indicated on the display, and the microcomputer being programmed to cause sequential actuation of the selecting indicia along a line or between lines in the same sense and direction as that corresponding to movement of the operator's finger with respect to the central reference position, the microcomputer being further programmed to select the selectable operating function displayed when the selecting switch is actuated. In one embodiment of the invention, the manual actuating means comprises four separate directional actuators arranged about a central actuator which operates the selecting switch. In another preferred embodiment, the manual actuating means is a single member adapted to movement in at least four directions corresponding to movement of the selecting indicia on the display and also adapted to be depressed in the center to operate the selecting switch. The functions selected may comprise operating modes of the wrist instrument or may comprise alphanumeric characters and/or mathematical operators.

DRAWINGS

The invention, both as to organization and practice, together with further objects and advantages thereof, will best be understood by reference to the following specification, taken in connection with the accompanying drawings, in which.

DESCRIPTION OF THE PREFERRED EMBODIMENT

Figure 1:
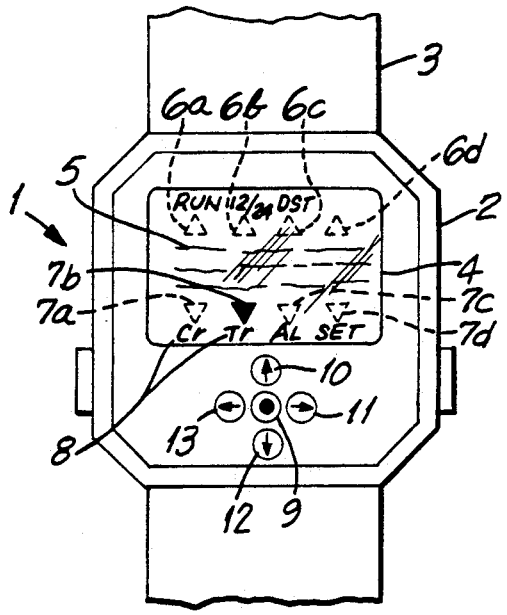
FIG. 1 is a simplified plan view of a first preferred embodiment of the invention having separate switch actuators.

Referring now to FIG. 1 of the drawing, a wrist instrument shown generally as 1 includes a case 2 attached to a strap 3 for mounting the wrist instrument on the wrist of an operator. An electro optical display 4 such as a liquid crystal display has actuatable display indicia to display timekeeping or other functional information 5, the nature of which is not material to the present invention, and selecting indicia *6a–6d, 7a–7d* which are relevant to the present invention. The display also includes permanent markings 8 indicating functions such as the current operating mode and other possible operating modes of the electronic wrist instrument. Markings 8 are arranged so as to be adjacent or otherwise in correspondence with one of the actuatable selecting indicia *6a–6d, 7a–7d*. Indicia *6a–6d* are arranged in a first horizontal line and indicia *7a–7d* are arranged in a second horizontal line. The first horizontal line is transversely spaced from the second horizontal line.

Indicia *7b* has been actuated to indicate that the operating function "Tr" (time remaining in a countdown mode) is one of several selectable functions or operating modes of the wrist instrument.

Disposed on the upper surface of the case are five manual actuators or push buttons arranged to operate corresponding switches inside the case. A selecting actuator 9 is disposed in a central reference position and is surrounded by four directional actuators 10, 11, 12 and 13 which are spaced from and surround the central reference position of actuator 9. Actuators 10 and 12 are arranged along a direction substantially perpendicular to the lines of selecting indicia *6a–6d, 7a–7d* on the display. Actuators 11 and 13 are arranged in a direction substantially parallel to the lines of selecting indicia on the display.

Figure 7:
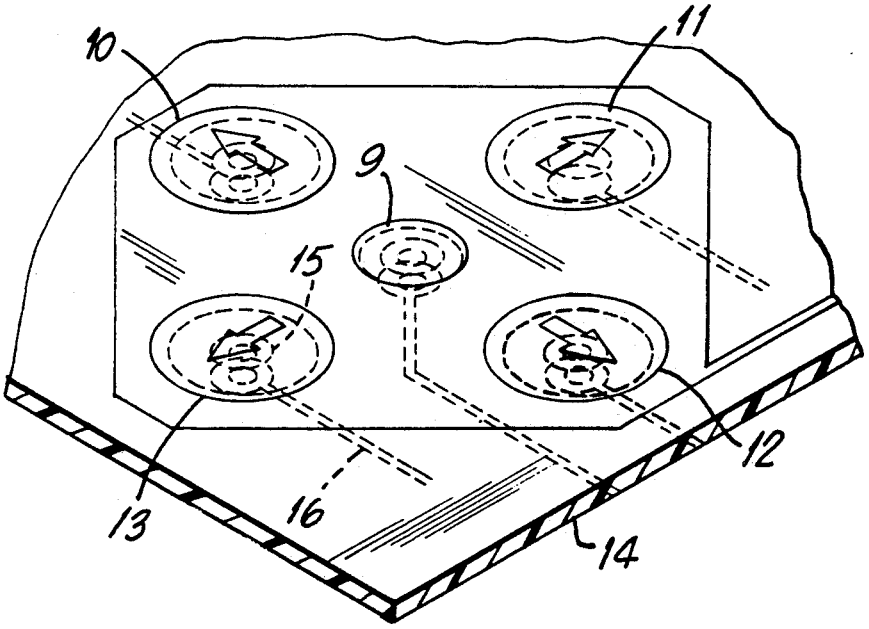
FIG. 7 is a perspective view of five separate actuators useful for the embodiment shown in FIGS. 1 and 5 above.

Actuators 9–13 may be of conventional construction and either constitute depressible buttons cooperating with spring contacts on a PC board inside the case, or may constitute membrane actuators carrying conductive portions cooperating with conductive layers. Reference to FIG. 7 illustrates a suitable construction for the actuators 9–13 which are flexible and depressible layers on a substrate 14 shown in partial cross-section. Typically a conductive ring 15 on the flexible portion is connected to common potential and conductive leads 16 are connected to terminals on a microcomputer located inside the case. Hence in this case, the actuators and switches are physically in close proximity with one another.

Figure 2:
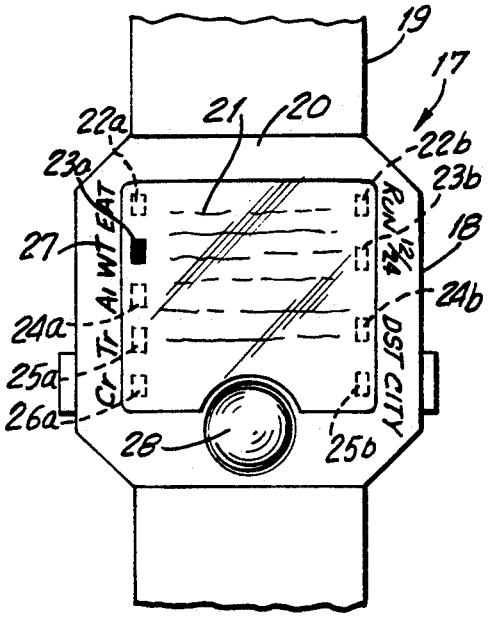
FIG. 2 is a simplified plan view of a second preferred embodiment of the invention having an integral manual actuator.

Reference to FIG. 2 of the drawing illustrates another preferred embodiment of the invention. A wrist instrument 17 includes a case 18 and strap 19. An electro optical display 20 includes actuatable indicia 21 containing information not material to the present invention and other actuatable selecting indicia 22a–26a in a first line or column and selecting indicia 22b–25b in a second transversely spaced line or column. The top surface of said case is described with symbols shown at 27 indicating a selectable function or operating mode, in this case "WT" (world time). The selecting indicia 23a is actuated adjacent to the WT symbol, indicating that this is a selectable function, but not necessarily a selected function, since the information indicia 21 may yet correspond to a different operating mode of the wrist instrument.

A single integrated actuator 28 on the watch case serves as manual actuating means for five switches contained inside the case. The function performed by the single actuator 28 is the same as that supplied by the separate manual actuators 10–13 of FIG. 1.

Figure 8:
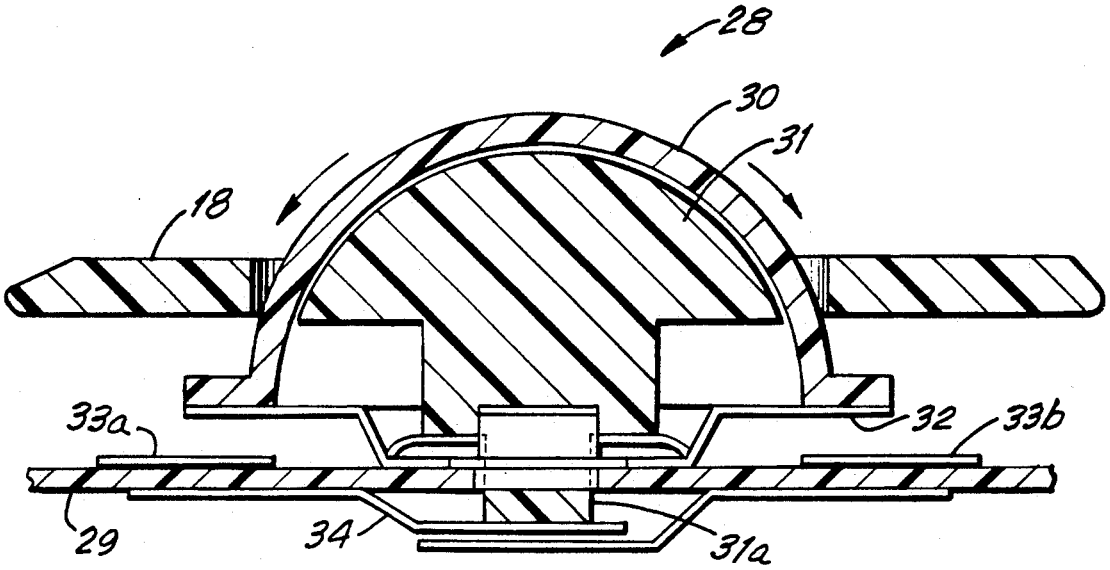
FIG. 8 and FIG. 9 are cross-sectional and perspective views respectably of a single integral actuator useful in the embodiments shown in FIGS. 2 and 3.
Figure 9:
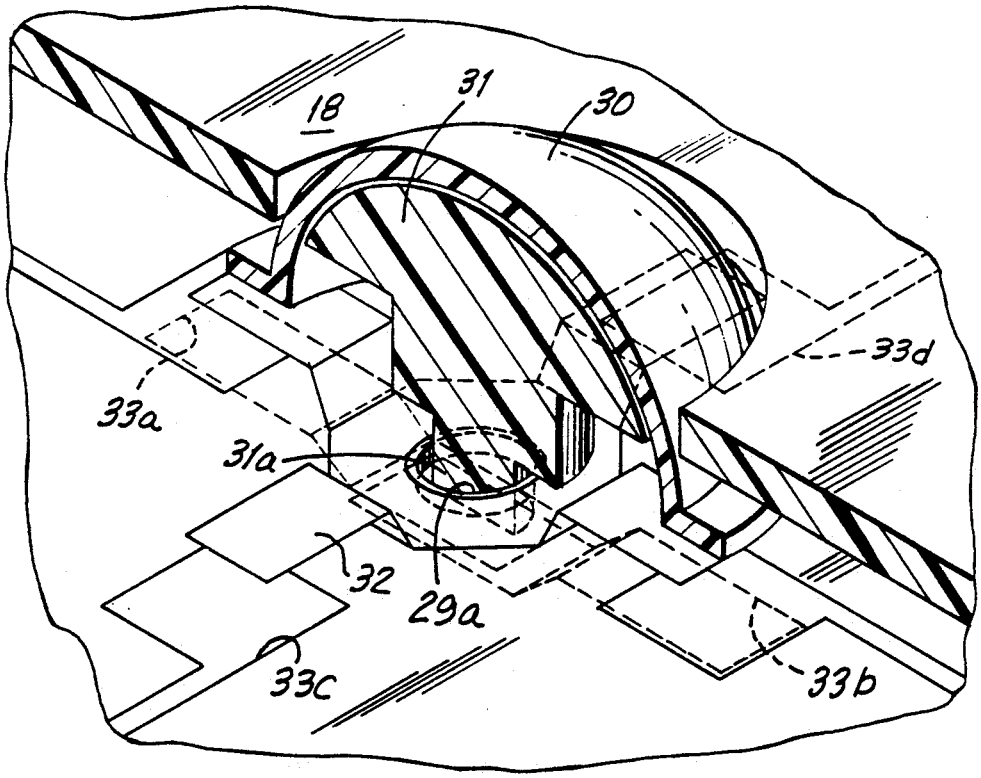

Reference to FIGS. 8 and 9 of the drawing illustrate a suitable construction for actuator 28. Referring to FIG. 8 of the drawing, portions of the watch case 18 are shown which enclose a printed circuit board 29 and a textured actuator dome 30. Dome 30 encloses a central insulated core 31 which is supported on a conductive four-leaved switch and return spring 32. The switch and return spring is arranged to make rocking contact with contacts 33a, 33b on the PC board. A protruding portion 31a of the core rests on one of a pair of spring contacts 34 comprising a selecting switch. Reference to the perspective view of FIG. 9 shows the shape and arrangement of the four-leaved switch and return spring 32 and illustrates that the projection 31a of the core passes through an aperture 29a in PC board 29. The four contact pads 33a, 33b, 33c, 33d are connected to the microcomputer inside the case. Pads 33a, 33b from a pair of directional switches which are spatially oriented so that movement of dome 30 by an operator's finger will correspond to the direction of the selecting indicia lines (or vertical columns) on the display. The pads 33c, 33d form a pair of directional switches which are directionally oriented so that movement of dome 30 by an operator's finger will correspond to the direction substantially perpendicular to the indicia lines on the display. Rocking movement caused by movement of an operator's finger from the central reference position and offset depression of dome 30 causes operation (closure) of directional switches in the same sense and direction as the lines of indicia on the display, or conversely in a sense and direction to effect transfer of actuated indicating indicia transversely between lines on the display.

Depression of the dome 30 directly downward at the central reference position causes operation (closure) of a selecting switch provided by spring contacts 34.

Figure 3:
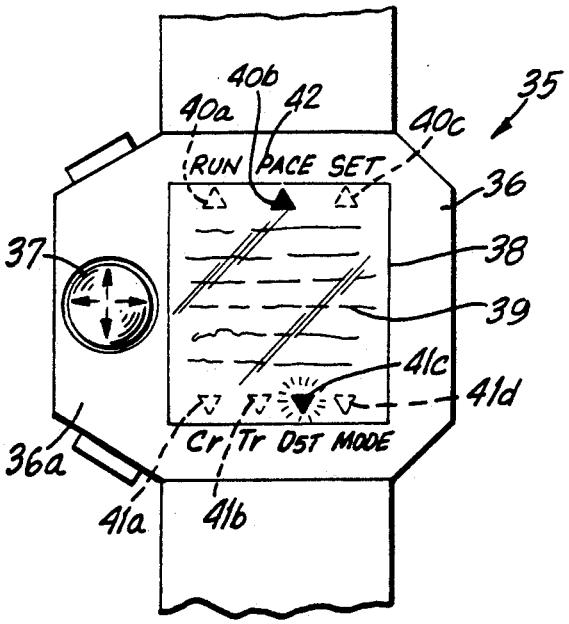
FIG. 3 is a simplified plan view of a wrist instrument having a single integrated manual actuator disposed on the side of the display.

Referring now to the remaining FIGS. 3–6 of the drawing, several variations in arrangement of selecting indicia and manual actuating means are shown which are within the scope of the present invention. In FIG. 3, a wrist instrument 35 includes a case 36 with an offset section 36a. A single manual actuator 37 is disclosed in the offset portion, which may be constructed like the one previously described as actuator 28.

A electro optic display 38 includes indicia 39 containing information not material hereto, selecting indicia 40a–40c arranged in a row or line along the top of the display and selecting indicia 41a–41d arranged in a second transversely spaced line or row along the bottom of the display. Symbols indicating a selectable operating function are shown as 42 inscribed on the case, although they could also be marked or inscribed on the display. Indicia 40b is actuated in one manner indicating a selectable operating mode or first function (shown in solid color) and indicia 41c is actuated in a second manner so as to visually distinguishable to an operator, e.g., by flashing off and on. Indicia 41c indicates a previously selected second function (or current operating mode) of the wrist instrument.

Figure 4:
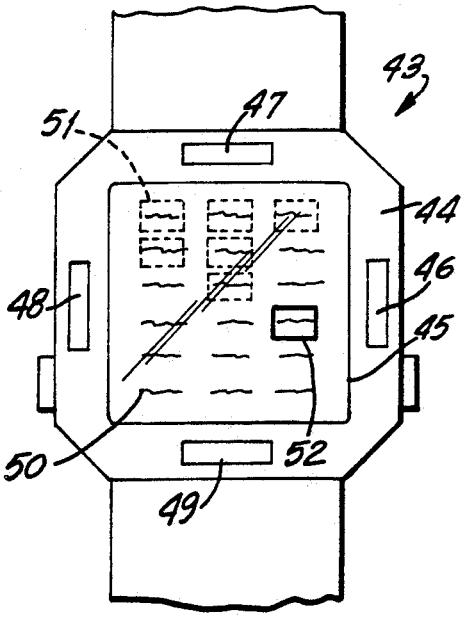
FIG. 4 is a simplified plan view of a wrist instrument having four actuators surrounding the display.

Referring to another modification in FIG. 4 of the drawing, a wrist instrument 43 includes a case 44 with an electro optical display 45 having a conductive or touch sensitive lens over the display in a central reference position. Conventional pushbutton actuators 46, 47, 48, 49 are arranged in opposed mutually perpendicular pairs around the lens 45. The display itself contains rows and orthogonal columns of alphanumeric characters and/or mathematical operator symbols indicated as 50 selecting indicia 51 arranged in rows and columns indicated by dotted line. Selecting indicia 51 comprise actuatable boxes surrounding the indicia 50, so as to designate the indicia 50 to be selected. One of such selecting indicia 51 is actuated as indicated at 52.

Actuators 46, 48 operate directional switches causing horizontal movement of boxed 51 and actuators 47, 49 operate directional switches causing vertical movement of boxes 51.

A selecting switch is provided at a central reference position among directional switch actuators 46–49 by the touch-sensitive lens of display 45. A suitable arrangement for a switching mechanism caused by the operator touching the lens is disclosed in U.S. Pat. No. 4,247,929 issued Jan. 27, 1981 to Sasaki.

Figure 5:
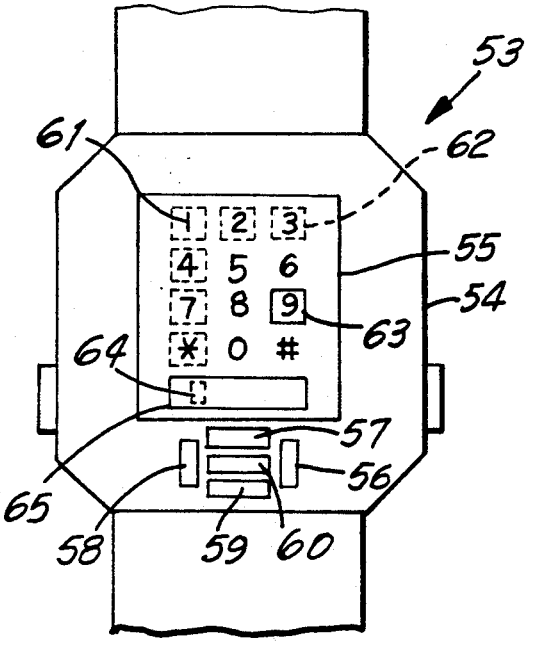
FIG. 5 is a simplified plan view of a wrist instrument having separate actuators and a different arrangement of display indicia.

Referring to the modification shown in FIG. 5, a wrist instrument 53 includes a case 54, electro optical display 55 and an array of four manual actuators 56, 57, 58, 59 operating internal directional switches, arranged around a central manual actuator 60 operating an internal selecting switch. The actuatable indicia on the display includes rows and orthogonal columns of numbers and symbols 61 which may either be actuatable indicia or permanently inscribed, surrounded by corresponding rows and orthogonal columns of actuatable selecting indicia, the latter indicated by dotted line boxes 62 surrounding the numbers 61. The number "9" is selectable or selected (as indicated at 63) and has been selected or entered as indicated by the actuated indicia 64 inside an inscribed box 65 on the display. Actuation of directional switch 57 moves the indicia box upward along the column, while actuation of directional switch 59 moves it downward along a column. Actuation of directional switch 58 moves the indicia box to the left on the display and actuation of directional switch 56 moves the box to the right on the display along the row. The program causing movement may be arranged to continuously step the selecting indicia along a line, or it may require repetitive depression of the actuator. Depression of actuator 60 at the central reference position selects the indicated function or data.

Figure 6:
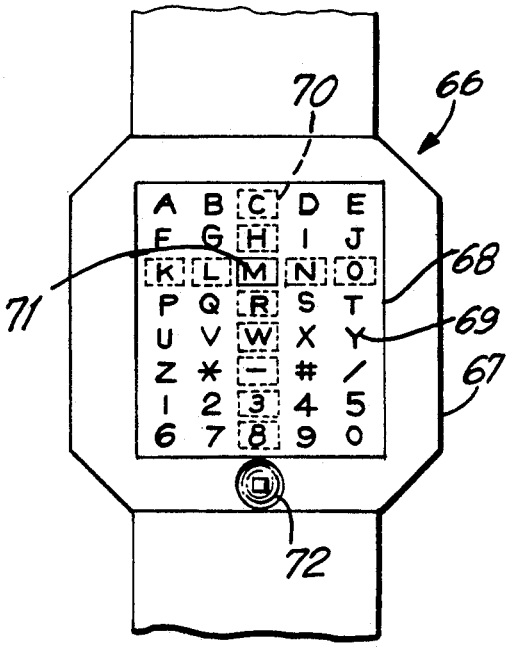
FIG. 6 is a simplified plan view of a wrist instrument having yet another arrangement of display indicia and a different type of single actuator.

Referring to FIG. 6 of the drawing, a wrist instrument 66 includes a case 67, an electro optical display 68 having alphanumeric characters 69 laid down in orthogonal rows and columns on the display and having actuatable indicia boxes 70 as previously described. One such box is shown actuated at 71.

The wrist instrument 66 includes a single manual actuator 72 having a flexibly mounted button arranged to move in four directions to close directional switches corresponding to the directional orientation and sense of direction of the rows and columns on the displays, and to be depressed to close a selecting switch at a central reference position to select a designated function or alphanumeric character or mathematical operator.

Figure 10:
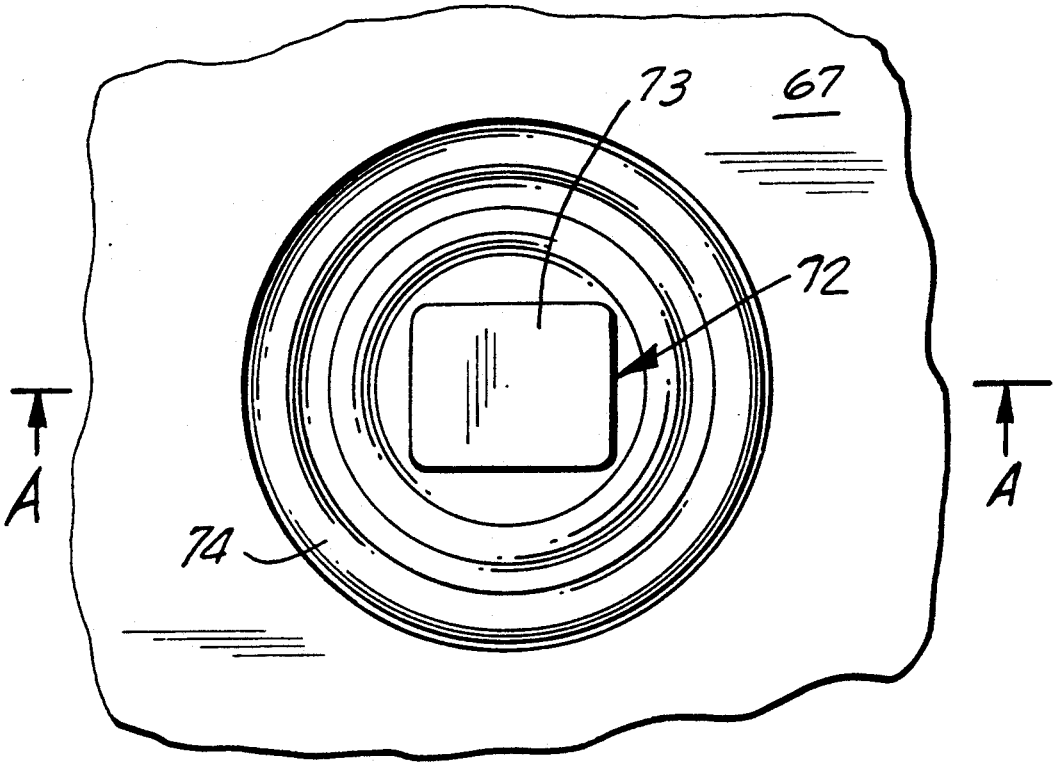
FIG. 10 is a simplified plan view of the integral actuator shown in FIG. 6.
Figure 11:
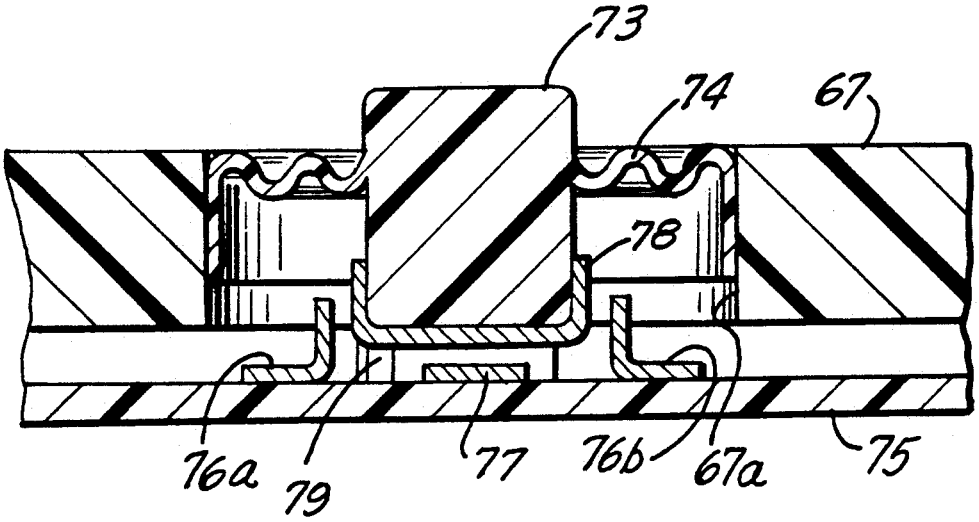
FIG. 11 is a simplified elevation view of the actuator shown in FIG. 10 taken along Section A—A.

FIGS. 10 and 11 show a suitable construction for manual actuator 72. Actuator 72 comprises a protruding button of insulating material supported on a corrugated flexible membrane 74 which is integral therewith. Reference to the cross section in FIG. 10 illustrates a PC board 75 carrying four spaced contacts, two of which are shown at 76*a*, 76*b* having upstanding portions, and a central contact 77. The membrane 74 supporting button 73 is folded and sealed into an aperture 67*a* in the watch case. The lower end of button 73 is supported in a conductive cup 78 which is flexibly supported on a conductive spring 79. Depression of button 73 vertically operates a selecting switch, while movement of the button 73 to and for or side to side operates four directional switches as before.

Figures 12, 13:
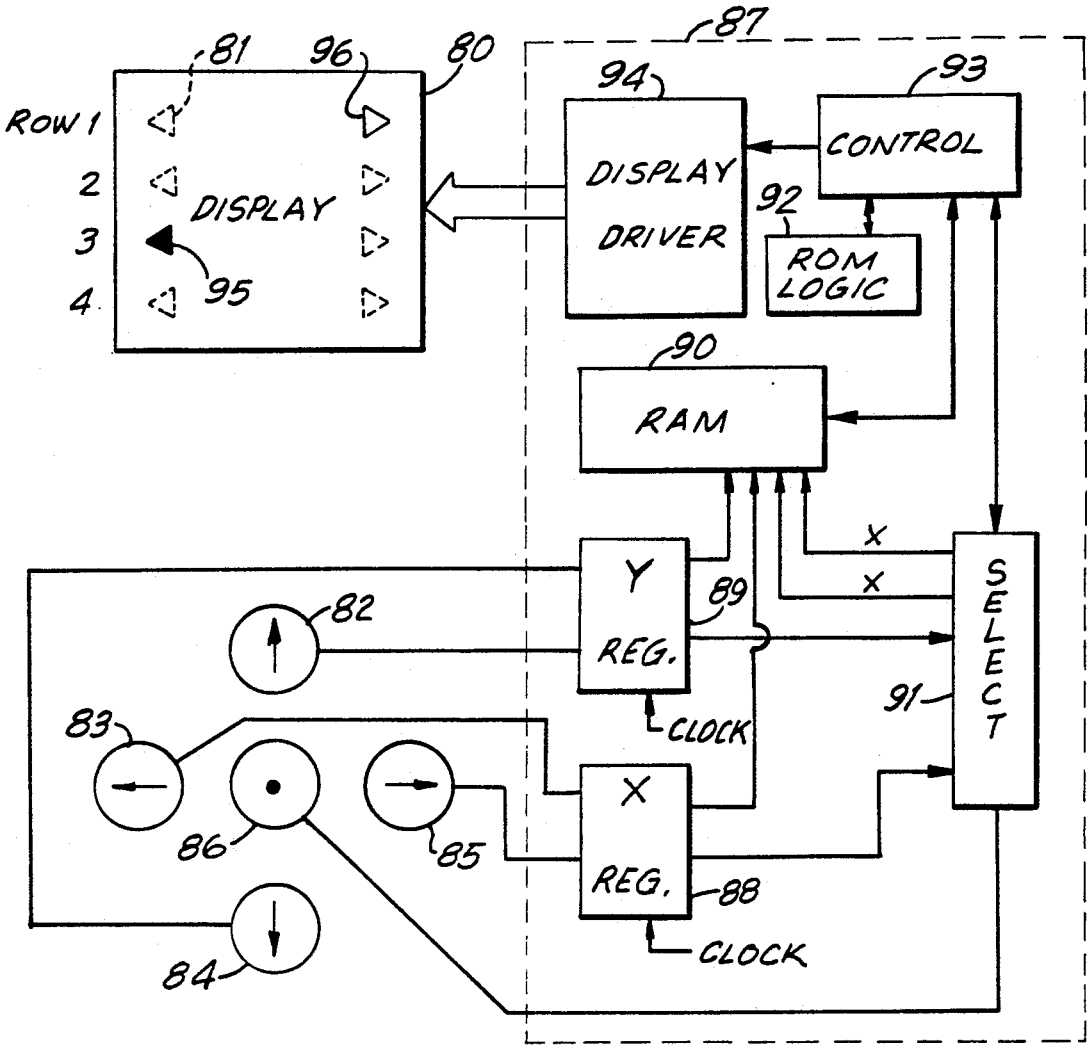
FIG. 12 is a simplified schematic diagram of display, microcomputer and actuating switches.
FIG. 13 is a simplified view representing memory locations in the microcomputer random access memory.

Referring now to FIGS. 12 and 13 of the drawing, a simplified schematic diagram illustrates the functional Operation of the microcomputer disclosed inside the case. Only a very simple representation is shown, it being understood that a microcomputer is usually provided in an integrated circuit form which includes a central processing unit, random access memory, read only memory containing an operating program, LCD display drivers, registers, gates, control, data and address buses, an on-chip oscillator, serial interface system, and timer. A suitable microcomputer for the present invention would be a Motorola model number MC68HC05 incorporating bidirectional input/out lines with debounced inputs.

In FIG. 12, the display is illustrated as 80 having actuatable selecting indicia 81. Directional switches 82, 83, 84, 85 are arranged about a selecting switch 86, it being understood that one pair of the switches 82, 84 are directionally arranged to correspond to the vertical lines of selecting indicia 81 on the display as previously described, while the other pair of switches 83, 85 are aligned in a direction perpendicular thereto. Functional elements of the microcomputer are indicated within the dotted line 87 and comprise an x-register 88 receiving input from switches 83, 85, a y-register 89 receiving input from switches 82, 84 and both providing output to first memory locations in a random access memory RAM 90. Registers 88, 89 are shown as separate devices to aid in explanation but actually would be included in RAM 90. X and Y-registers 88, 89 provide output representing horizontal or vertical position respectively of the selecting indicia to a select gate 91. Function selecting switch 86 is operably connected to select gate 91. The output of select gate 91 representing selected indicia location is supplied to a second memory location in RAM 90. Operation of the microcomputer under the operating program contained in a read only memory ROM 92 is represented by a control block 93. Visual display of the location of the selecting indicia, as well as possible additional indication of a previously selected selecting indicia is provided by a display driver 94.

Reference to FIG. 13 gives a simplified illustration of the first and second memory locations. The selecting indicia locations on the display may be represented by two columns A and B and four rows, 1, 2, 3, 4. The first memory location indicates the current position of the display "cursor" i.e., the actuated selecting indicia in the x and y-register. This is represented by any actuated indicia 95 whose position on the display can be represented in a first memory location as A3. The previous selected, or second function (representing the current operating mode of the wrist instrument) is stored in a second memory location B1. If desired this may be also indicated on the display in a visually distinguishable manner by outline segments as shown at 96 or by flashing the segment.

FLOW CHART

Figure 14:
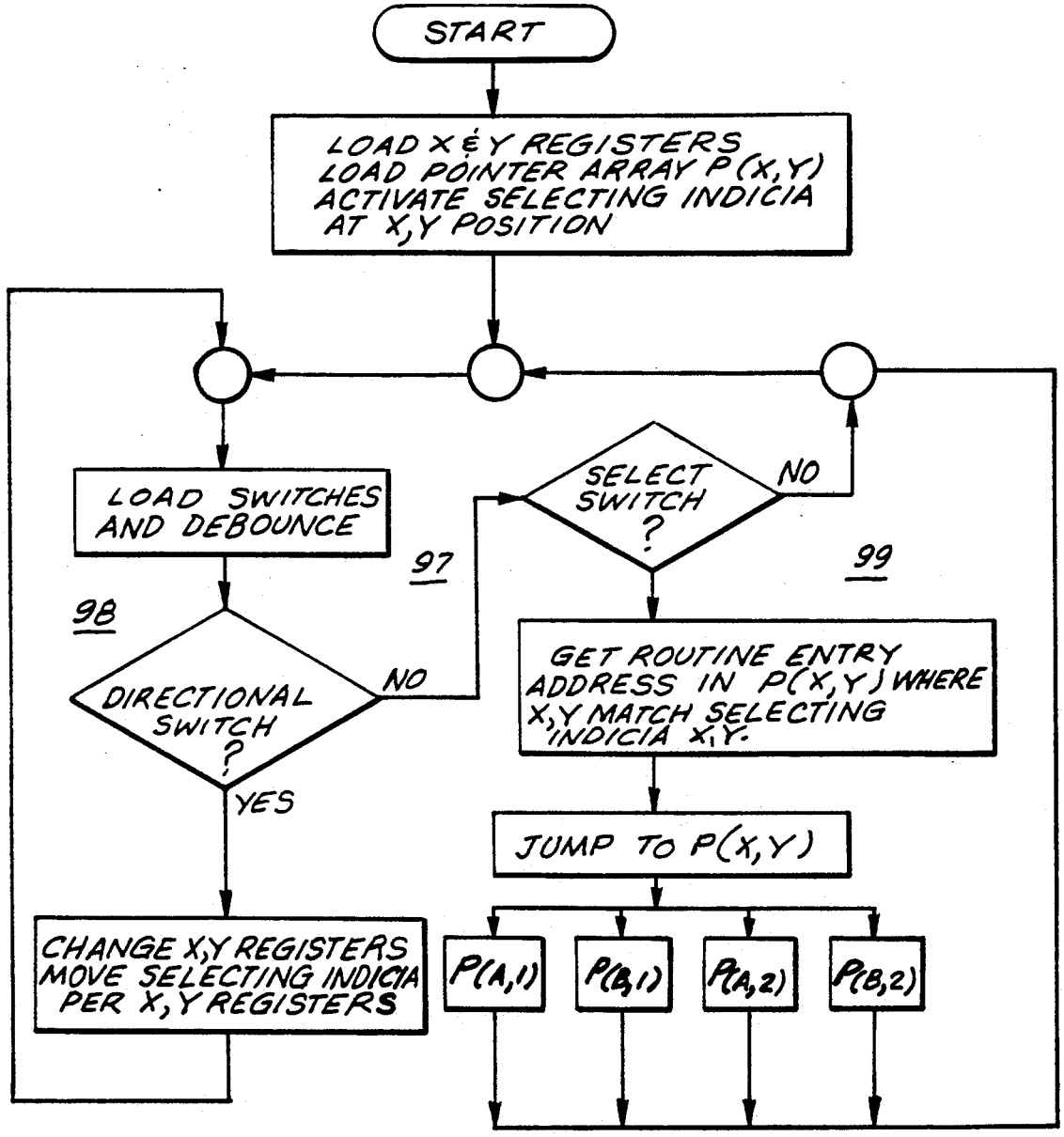
FIG. 14 is a flow chart illustrating the operation of the program.

FIG. 14 comprises a flow chart illustrating the operation of the operating program to carry out the aforesaid functions.

A normal routine by the operating program is shown by loop 97, in which the program continuously checks the possibility of operation of any one of the four directional switches or operation of the selecting switch.

Operation of any directional switch causes the program to enter a routine designated by loop 98 in which information in the x, y registers is changed along with changes of location on the display of the selecting indicia. When a directional switch is no longer closed, loop 97 is resumed until another operation of a directional switch or operation of the select switch is detected.

Operation of the select switch commences a routine designated by loop 99 in which the pointer at location x, y corresponding to x, y selected from the register causes execution of the appropriate function.

The Motorola microcomputer ROM is programmed to carry out the above functions shown on the flow chart of FIG. 14 in a manner well known to those skilled in the art. The term microcomputer and microcontroller are used herein interchangeably.

It will be understood that reference herein to selecting indicia for a function is construed in its broadest sense as designation of any desired operating mode of the wrist instrument or selection of alphanumeric characters of mathematical operators to be stored and operated on or displayed by the wrist instrument It is understood that manual actuating means is construed to mean either separate manual actuators or a single manual actuator arranged to be operated in the manner described so as to move the selecting indicia directionally on the display to correspond to the operator's finger movement on the manual actuating means from the central reference position and selection thereof, by actuation at a central reference position. While operation of the switches is illustrated by closure of contacts, operation can also be accomplished by opening of normally closed contacts.

It is also understood that the term "line" of selecting indicia may signify a vertical line (column), a horizontal line (row) or a diagonal line of indicia. If the data is arranged in concentric circles, sequential actuation along a "line" is broadly construed as movement around a circle of indicia, while transverse movement perpendicular thereto means radial transfer between such circles.

While there has been described herein what is considered to be the preferred embodiment of the invention and several modifications thereof, it is desired to secure in the appended claims all such modifications as fall within the true spirit and scope of the invention.

I claim:

1. Improved selecting apparatus for a multimode electronic wrist instrument of the type having a wrist-mounted case, a microcomputer in a said case programmed to provide a plurality of functions including timekeeping and other functions, and an electro optical display having actuatable display indicia, said apparatus comprising:

a plurality of selecting indicia arranged on said display in a first line and at least one transversely spaced second line parallel to said first line, each of said selecting indicia adapted to indicate a selectable function of said wrist instrument, a plurality of directional switches in said case connected to said microcomputer, said microcomputer being programmed to sequentially actuate said indicia along said lines to indicate a said selectable function in response to operation of one of said directional switches, a selecting switch connected to said microcomputer, manual actuating means disposed on said case adapted to operate said selecting switch at said central reference position and to operate at least four of said directional switches by movement of an operator's finger from said central reference position toward a selected one of four locations on said case, said four locations being spaced from and surrounding said central reference position, a first pair of said locations being directionally oriented on the case to correspond to the directional orientation of said lines and a second pair of said locations being directionally oriented on the case substantially perpendicular to said lines, said microcomputer having a first memory location for storing a first function corresponding to said selectable function indicated by an actuated indicia on said display, said microcomputer having a second memory location for storing a second function and adapted to operate said wrist instrument in accordance with said second function, and said microcomputer being programmed (1) selectively to cause sequential actuation of said selecting indicia along a said line on the display in the same sense and direction as that corresponding to movement of the operator's finger with respect to said central reference position, and (2) selectively to cause transfer of the actuation of said indicia between said first and second lines on the display in the same sense and direction as that corresponding to movement of the operator's finger with respect to said central reference position, said microcomputer being further programmed (3) to select the selectable function displayed when said selecting switch is operated at said central reference position.

2. The combination according to claim 1, wherein said selecting indicia are arranged on said display in first and second transversely spaced columns.

3. The combination according to claim 1, wherein said selecting indicia are arranged on said display in transversely spaced first and second rows.

4. The combination according to claim 1, wherein said selectable functions of said wrist instrument comprise a plurality of actuatable elements on said display arranged along said first and second lines in correspondence with said selecting indicia.

5. The combination according to claim 1, wherein said selectable functions of the wrist instrument are symbols inscribed on the case along first and second lines in correspondence with said first and second lines of indicia.

6. The combination according to claim 1, wherein said directional switches and said selecting switch are operated by separate actuators which collectively comprise said manual actuating means.

7. The combination according to claim 1, wherein said manual actuating means comprises a single actuator adapted to operate said directional switches by movement away from said central reference position and to operate said selecting switch by depression of an operator's finger at said central reference position.

8. The combination according to claim 1, wherein said microcomputer is programmed to actuate said selecting indicia at a display location corresponding to said first function stored in said first memory location.

9. The combination according to claim 1, wherein said microcomputer program is arranged to actuate a selected function indicated by an actuated indicia at a display location corresponding to the second function stored in said second memory location.

10. The combination according to claim 1, wherein said microcomputer is programmed to actuate a first display indicia corresponding to said first function stored in said first memory location and to actuate a second display indicia according to said second function stored in said second memory location, said first and second display indicia being actuated in a manner to be visually distinguishable from one another to said operator.

11. The combination according to claim 1, wherein said microcomputer is programmed to cause sequential actuation of said indicia along a said line on the display in response to repetitive operation of a selected directional switch.

12. The combination according to claim 1, wherein said transfer of actuation of selecting indicia between said lines is in response to repetitive operation of a selected directional switch.

13. The combination according to claim 1, wherein said microcomputer is programmed to transfer the contents of said second memory location to said first memory location upon operation of said selecting switch.

14. The combination according to claim 1, wherein said selectable function said first function and said second function comprise operational modes of said wrist instrument.

15. The combination according to claim 1, wherein said selectable function, said first function and said second function comprise alphanumeric characters and/or mathematical operators to be stored in said microcomputer.

* * * * *